US005080078A

United States Patent [19]

Hamburg

[11] Patent Number: 5,080,078

[45] Date of Patent: Jan. 14, 1992

[54] FUEL VAPOR RECOVERY CONTROL SYSTEM

[75] Inventor: Douglas R. Hamburg, Birmingham, Mich.

[73] Assignee: Ford Motor Company, Dearborn, Mich.

[21] Appl. No.: 447,336

[22] Filed: Dec. 7, 1989

[51] Int. Cl.[5] ..... F02M 33/02

[52] U.S. Cl. ..... 123/521; 123/519; 60/605.1

[58] Field of Search ..... 123/516, 518, 519, 520, 123/521, 383, 489; 60/605

[56] References Cited

U.S. PATENT DOCUMENTS

| | | | |
|---|---|---|---|
| 3,680,318 | 8/1972 | Nakajima | 123/519 |
| 4,026,258 | 5/1977 | Ino | 123/520 |
| 4,445,336 | 5/1984 | Inoue | 60/605.1 |
| 4,498,443 | 2/1985 | Hasegawa | 60/605.1 |
| 4,530,210 | 7/1985 | Yamazaki . | |
| 4,664,087 | 5/1987 | Hamburg | 123/520 |
| 4,677,956 | 7/1987 | Hamburg | 123/520 |
| 4,715,340 | 12/1987 | Cook et al. . | |

*Primary Examiner*—Carl Stuart Miller

*Attorney, Agent, or Firm*—Allan J. Lippa; Peter Abolins

[57] ABSTRACT

A control system for an engine having both a fuel vapor recovery system and air/fuel ratio feedback control. The engine is equipped with a venturi in its intake passage. A vapor reservoir is coupled between the fuel vapor recovery system and a nozzle orifice positioned in the venturi throat. Vapor flow into the reservoir is regulated by a solenoid valve responsive to a pressure switch which is referenced to the venturi inlet pressure. Action of the pressure switch maintains reservoir pressure at the venturi inlet pressure such that vapor flow is linearly proportional to inducted air flow regardless of engine manifold pressure. In an alternate embodiment, the fuel tank is coupled to the venturi through a pressure regulating system as described above. The vapor recovery canister is independently coupled to the venturi through a similar pressure control system.

4 Claims, 5 Drawing Sheets

FUEL VAPOR RECOVERY CONTROL SYSTEM

BACKGROUND OF THE INVENTION

The field of the invention relates to fuel vapor recovery systems coupled to internal combustion engines. In one particular aspect, the invention relates to air/fuel ratio control for engines equipped with fuel vapor recovery systems.

Fuel vapor recovery systems are commonly employed on modern motor vehicles to reduce atmospheric emissions of hydrocarbons. Typically, a storage canister containing activated charcoal is coupled to the fuel tank for adsorbing hydrocarbons which would otherwise be emitted into the atmosphere. Such storage canisters may also be utilized to capture hydrocarbons when filing the fuel tank. To cleanse the canisters, ambient air is occasionally purged through the canister for absorbing stored hydrocarbons and inducting the purged hydrocarbon vapors into the engine. In addition, fuel vapors are inducted directly from the fuel tank into the engine. In modern automobiles with fuel injected engines it has become increasingly desirable to purge fuel vapors directly from the fuel tank as often as possible. The rate of vapor flow, from both the fuel tank and canister, is typically controlled by pulse width modulating an electronically actuated solenoid valve.

In motor vehicles equipped with air/fuel ratio feedback control systems, it has been found desirable to regulate the induction of fuel vapors such that the rate of vapor flow is proportional to inducted air flow. For example, U.S. Pat. No. 4,715,340 issued to Cook et al controls the rate of vapor flow to be proportional to a calculation of inducted air flow (or, similarly, desired fuel charge calculation) such that the overall inducted mixture of air, fuel, and fuel vapor remains within the feedback system's range of authority. Air/fuel ratio transients which would otherwise occur during the onset of vapor induction are also reduced by maintaining vapor flow proportional to inducted air flow. This is accomplished by actuating the solenoid valve of the vapor recovery system with an electrical signal having a pulse width proportional to a measurement of inducted air flow.

The inventor herein has recognized several problems with conventional fuel vapor recovery systems, especially when these systems are used with engines having air/fuel ratio feedback control systems. More specifically, in turbocharged engines, supercharged engines, or multi valve per cylinder engines, there may be insufficient manifold vacuum to induct fuel vapors. Further, even when there is sufficient vacuum for vapor induction, the vacuum may not be sufficient to provide sonic vapor flow through the regulating valve. Accordingly, vapor flow through the valve will be a function of both the valve on-time and the pressure differential across the valve. Thus, maintaining fuel vapor flow as a proportion of induced air flow may not be achievable.

U.S. Pat. No. 4,530,210 issued to Yamazaki addresses only one of the problems discussed above. More specifically, in the case of a turbocharged engine, the '210 patent discloses pressurizing the fuel vapor storage canister such that vapor flow is forced into the air intake when the engine throttle is opened sufficiently to reduce intake pressure below atmospheric pressure. The inventor herein has recognized several disadvantages of the approach disclosed in the '210 patent. For example, by pressurizing the vapor canister, it may not be possible to concurrently induct fuel vapors from both the fuel tank and canister. As discussed herein above, induction of fuel vapors directly from the fuel tank has become increasingly desirable in today's fuel injected engines. Another disadvantage of the approach disclosed in the '210 patent is that vapor induction apparently cannot occur over the full engine operating cycle. As stated above, there must be a negative pressure near the engine throttle for vapor purge to occur.

SUMMARY OF THE INVENTION

An object of the invention herein is to concurrently induct fuel vapors from both the fuel tank and vapor canister at a rate proportional to inducted air flow regardless of engine intake manifold pressure.

The above object is achieved, and problems and disadvantages of prior approaches overcome, by providing a control system for an internal combustion engine having a fuel vapor recovery system coupled to a fuel system. In one particular aspect of the invention, the control system comprises: an air intake system including a venturi for inducting air into the engine; and pressure regulating means having an inlet coupled to the fuel vapor recovery means and an outlet coupled to a throat of the venturi for regulating vapor flow in proportion to inducted air flow, the pressure regulating means being responsive to pressure at an inlet of the venturi.

The above aspect of the invention provides an advantage of inducting fuel vapors in proportion to inducted air flow regardless of engine intake manifold pressure.

In another aspect of the invention, the control system comprises: a control system for an internal combustion engine having an intake manifold for inducting air and fuel from a fuel system into the engine, comprising: fuel vapor recovery means coupled to the fuel system for providing fuel vapors to the intake manifold; a venturi coupled to the manifold for inducting air therein; pressure regulation means coupled between the fuel vapor recovery system and the venturi throat, the pressure regulation means being responsive to pressure differential between the venturi throat and a position upstream of the venturi throat for regulating flow of fuel vapors in proportion to flow of the inducted air independently of pressure in the intake manifold; and air/fuel ratio feedback control means responsive to a calculation of air flow inducted into the intake manifold and also responsive to an exhaust gas oxygen sensor for regulating a mixture of air and fuel and fuel vapor inducted into the intake manifold. Preferably, the fuel vapor recovery means is coupled directly to both a fuel tank and a fuel vapor recovery canister for concurrently inducting fuel vapors from both the fuel tank and canister.

The above aspect of the invention provides an advantage of inducting fuel vapors in proportion to inducted air flow regardless of engine intake manifold pressure. Another advantage provided by the above aspect of the invention is that fuel vapors may be concurrently inducted directly from both the fuel tank and fuel vapor recovery canister.

DESCRIPTION OF THE DRAWINGS

The invention claimed herein will be better understood by reading an example of an embodiment which utilizes the invention to advantage, referred to herein as the preferred embodiment, with reference to the drawings wherein:

FIG. 3C is a graphical representation of control system response to the hypothetical pressure variation shown in FIG. 3A;

DESCRIPTION OF THE PREFERRED EMBODIMENT

Figure 1:
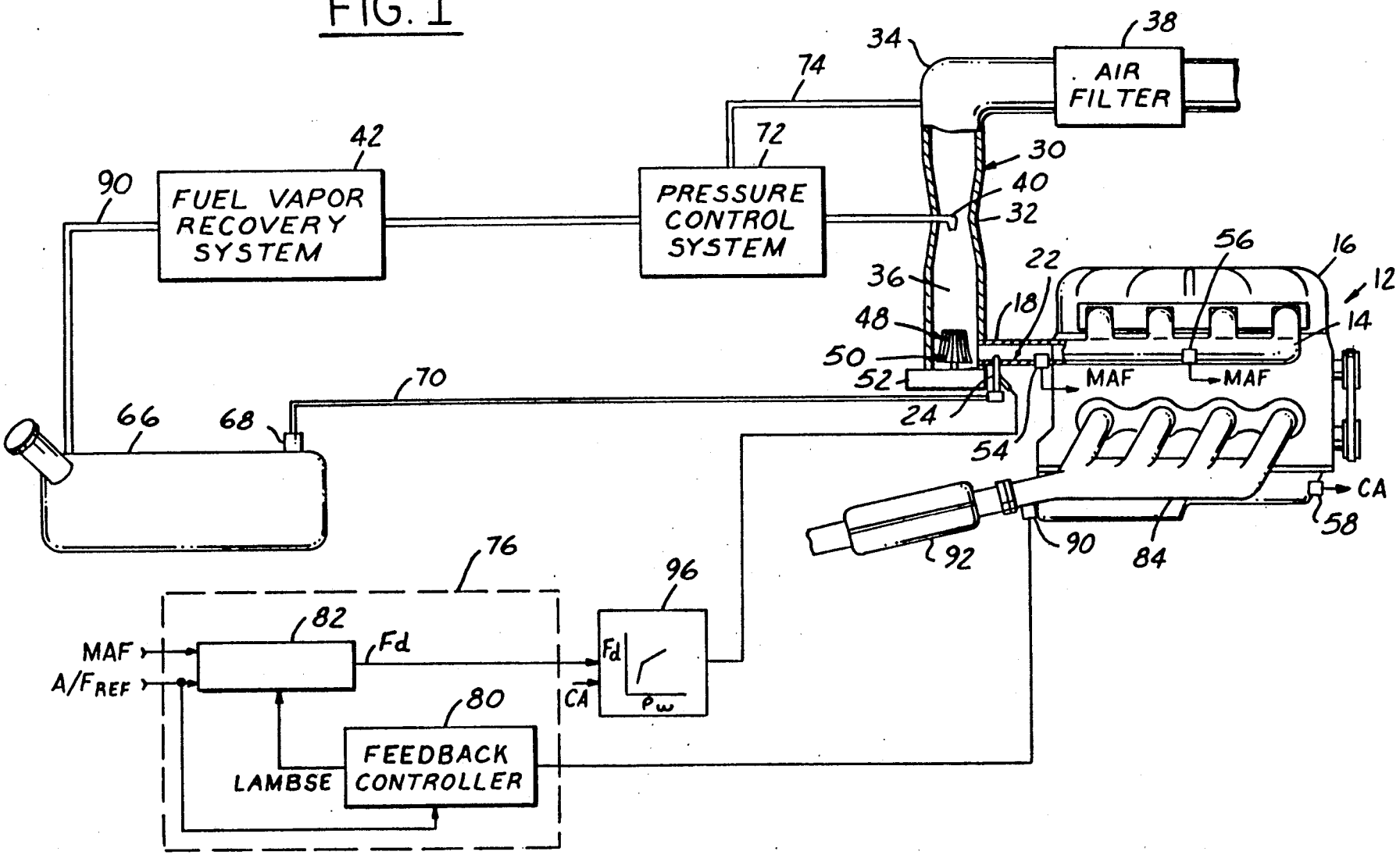
FIG. 1 is a block diagram of an engine, air/fuel ratio feedback control system, and fuel vapor control system in which the invention is used to advantage.

Referring first to FIG. 1, engine 12 is shown having intake manifold 14 coupled to engine head 16 for supplying a mixture of air, fuel, and fuel vapor to each of the combustion chambers (not shown). Intake manifold 14 includes throttle body 18 which is shown having throttle plate 22 positioned therein and is also shown receiving fuel from conventional fuel injector 24. Venturi 30 is shown having throat 32 and inlet end 34 coupled to intake air filter 38. Outlet end 36 of venturi 30 is shown coupled to throttle body 18. As described in greater detail later herein, discharge nozzle 40 is shown coupled to venturi throat 32 for supplying fuel vapors from fuel vapor recovery system 42. In this particular example, supercharger 48 is shown including air fins 50 positioned in outlet end 36 of venturi 30 and driven by mechanism 52 (which is typically coupled to the engine crankshaft) for forcing air and fuel vapors into intake body 18.

Various sensors are shown coupled to engine 12 for supplying indications of engine operation. Mass air flow sensor 54 is shown coupled to throttle body 18 for providing a measurement of mass air flow (MAF) inducted into engine 12. Manifold pressure sensor 56 provides a measurement of absolute manifold pressure (MAP) in intake manifold 14. Crank angle sensor 58, coupled to the engine crankshaft (not shown), provides angular position (CA) of engine 12. It is noted that these and other indications of engine operating parameters may be provided by other conventional means. For example, inducted air flow may be provided from signal MAP and engine speed by utilizing known speed density algorithms. It is further noted that various engine systems such as the ignition system are not shown because they are not necessary for an understanding of the invention.

Fuel tank 66 is shown supplying fuel to fuel injector 24 via conventional fuel pump 68 and fuel line 70. As described in greater detail herein, fuel vapor recovery system 42 is coupled to fuel tank 66 for supplying fuel vapors, from both fuel tank 66 and vapor recovery canister 60 (FIG. 2), to pressure control system 72. Pressure reference line 74 is shown coupled between inlet 34 of venturi 30 and pressure control system 72 for supplying a reference pressure. Pressure control system 72 provides fuel vapors to venturi 30 through nozzle orifice 40 at a flow rate proportional to the air flow inducted through venturi 30 from air filter 38.

Air/fuel ratio feedback control system 76 is shown including feedback controller 80 and desired fuel charge calculator 82. Feedback controller 80, a proportional integral feedback controller in this example, provides correction signal LAMBSE in response to a rich/lean indication from two-state exhaust gas oxygen (EGO) sensor 90 which is coupled to exhaust manifold 84. Fuel charge calculator 82 first divides a measurement of mass air flow (MAF) by an air/fuel reference ($A/F_{Ref}$) to generate and open loop fuel charge. This value is then corrected (i.e. divided) by LAMBSE for generating corrected desired fuel charge signal Fd such that the actual air/fuel ratio among the combustion chambers averages at $A/F_{Ref}$. In this particular example, $A/F_{Ref}$ is chosen as 14.7 lbs air per lb of fuel which is within the operating window of three way ($NO_x$, CO, HC) catalytic converter 92. Desired fuel charge signal Fd is then converted into pulse width modulated signal pw by conventional fuel controller 96 for actuating fuel injector 24. In response, fuel injector 24 delivers an actual fuel charge correlated with signal Fd.

Figure 2:
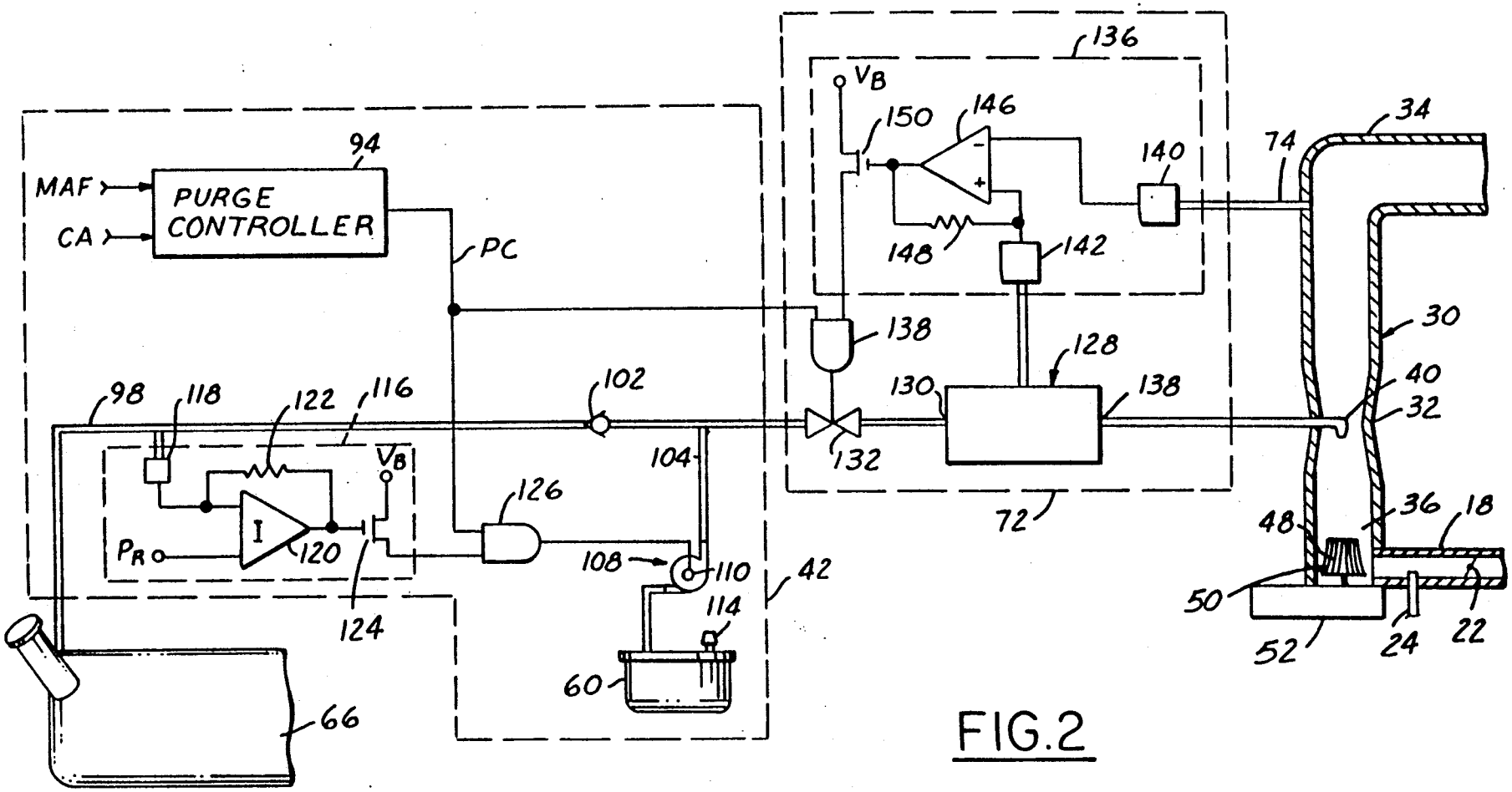
FIG. 2 is a more detailed block diagram of the fuel vapor control system shown in FIG. 1.

Referring now to FIG. 2, a more detailed block diagram of a fuel vapor control system is shown including fuel vapor recovery system 42, pressure control system 72, and venturi 30. Fuel vapor recovery system 42 is shown including vapor purge controller 94 which enables vapor induction from both fuel tank 66 and canister 60 under certain engine operating conditions. In response to signal MAF and signal CA, purge controller 94 enables vapor purge by generating purge command PC when engine RPM and inducted air flow are above minimum conditions. For the embodiment shown herein, vapor purge is enabled at idle speed conditions and above. In this particular example, vapor recovery system 42 is also shown including vapor line 98 from fuel tank 66 coupled to vapor storage canister 60, an activated charcoal canister in this example, via check valve 102 and lead line 104. For reasons described later herein, electric pump 108, is shown inserted in lead line 104. Canister 60 is shown including atmospheric vent 114.

Electric motor 110 of pump 108 is shown electronically actuated by pressure switch 116. In this particular example, pressure switch 116 includes pressure transducer 118 coupled to vapor line 98 for providing an electrical signal which is proportional to vapor pressure in vapor line 98. Comparator 120 of pressure switch 116 is an analog comparator in this example having one input coupled to reference pressure signal $P_R$ and the other input coupled to pressure transducer 118. Feedback resistor 122 provides desired hysteresis to the electrical comparison performed by comparator 120. The output of comparator 120 biases the control electrode of switching transistor 124, a field effect transistor in this example, which has output electrodes connected in series between electric motor 110 of pump 108 and an electrical power source ($V_B$). Gate 126 is shown responsive to purge command signal PC and inserted between switching transistor 124 and electrical motor 110 for blocking actuation of motor 110 when a purge command is not present. It is noted that pressure switch 116 is here shown fabricated by analog circuits. Those skilled in the art, however, recognize that mechanical pressure switches utilizing diaphragms and valves may also be used to advantage.

Figure 3A:
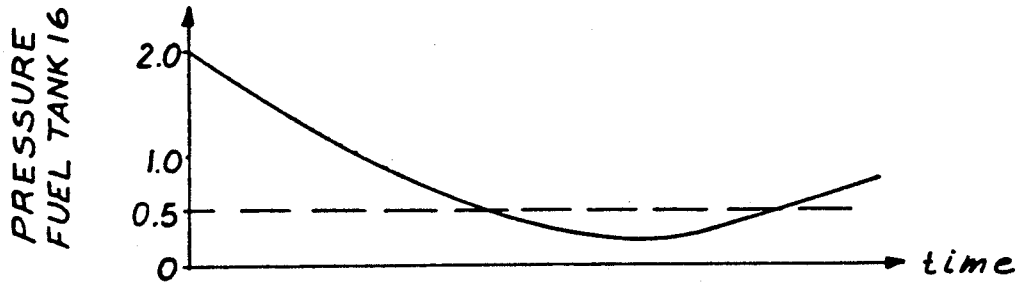
FIG. 3A is a graphical representation of a hypothetical variation in fuel tank pressure.
Figure 3B:
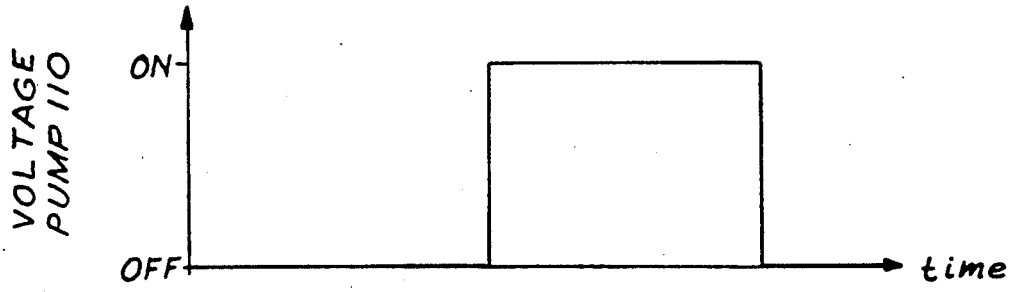
FIG. 3B is a graphical representation of control system response to the pressure variation shown in FIG. 3A.

The operation of fuel vapor recovery system 42 is now described with reference to FIGS. 3A and 3B. Pump 108 is shown inactive when vapor pressure in vapor line 98, and accordingly fuel tank 66, is above $P_R$ (chosen in this example as 0.5 psi). Thus, when vapor induction is enabled (i.e., signal PC is active) and fuel tank pressure is above $P_R$, fuel vapor recovery system 42 provides vapor only from fuel tank 66. This strategy is selected to optimize vapor recovery from fuel tank 66 and regulate fuel tank pressure. When vapor purge is enabled and the pressure in vapor line 98 is below $P_R$, low pressure pump 108 is actuated for purging hydrocarbons from canister 60 into pressure control system 72.

Referring back to FIG. 2, pressure control system 72 and its interconnection with venturi 30 is now described. Pressure control system 72 is shown including vapor reservoir 128 having inlet 130 coupled to fuel vapor recovery system 42 via solenoid valve 132. Outlet 138 of vapor reservoir 128 is shown coupled to venturi throat 32 via nozzle orifice 40. Solenoid valve 132 is actuated by differential pressure switch 136 through gate 138 such that solenoid valve 132 can only be actuated when purge command PC is enabled.

Differential pressure switch 136 is shown responsive to a predetermined difference in pressure between venturi inlet 34 and the pressure in vapor reservoir 128. In this particular example, pressure switch 136 includes pressure transducer 140 coupled to venturi inlet end 34 via reference line 74 for providing an electrical signal proportional to pressure at inlet 34. Pressure transducer 142 is shown coupled to reservoir 128 for providing an electrical signal proportional to the pressure therein. Analog comparator 146 is coupled to pressure transducers 140 and 142 for providing an electrical output when the difference in pressure exceeds a hysteresis value determined by feedback resistor 148. Switching transistor 150, having a control electrode coupled to the output of analog comparator 146, is shown coupled in series between voltage source $V_B$ and gate 138.

Figure 4:
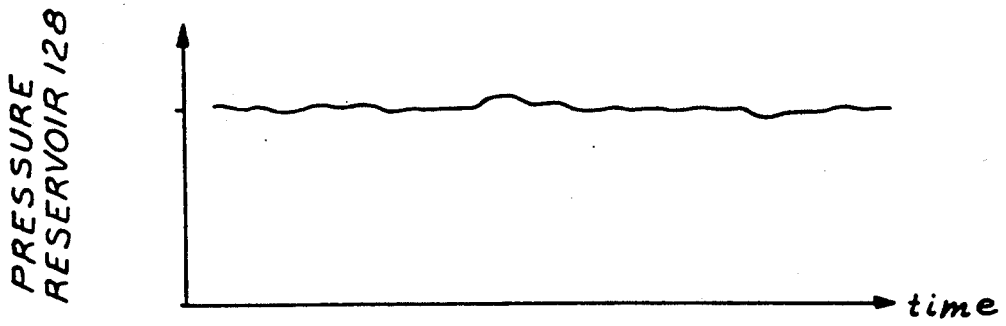
FIG. 4A is a graphical illustration of an example of an operation wherein inducted air flow is abruptly changed.
FIG. 4B is a graphical illustration of the fuel vapor control system responding to the illustrative example shown in FIG. 4A.
FIG. 4C is a graphical illustration of vapor flow controlled by the fuel vapor control system responding to the illustrative example of operation shown in FIG. 4A.
FIG. 4D is a graphical illustration of air/fuel ratio control correlated with the operations depicted in FIGS. 4A–4C.

In operation, pressure switch 136 opens and closes solenoid valve 132 to maintain pressure within reservoir 128 at approximately the inlet pressure of venturi 30 as shown in FIG. 4. In this manner, the purge flow through nozzle orifice 40 is made proportional to the pressure drop at venturi throat 32 which in turn is proportional to inducted air flow. Thus, purge flow occurs regardless of engine manifold pressure and is also proportional to inducted air flow regardless of engine manifold pressure. Further, vapor flow is inducted concurrently from both fuel tank 66 and vapor canister 60.

Figure 4A:
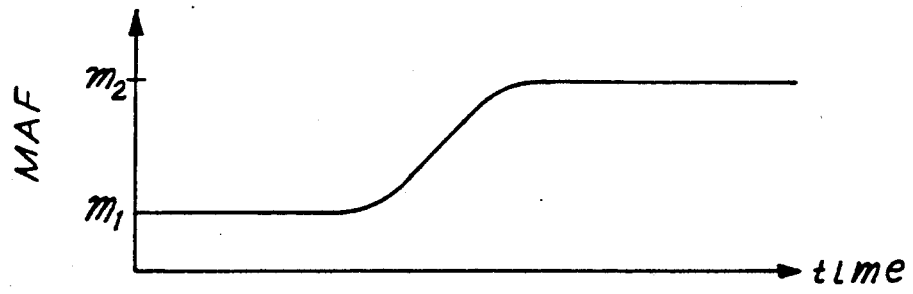
Figure 4B:
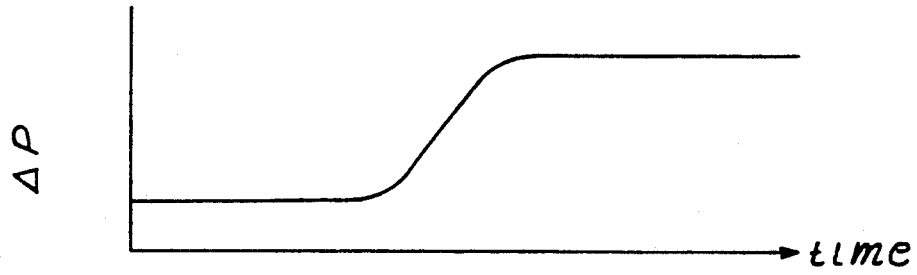
Figure 4C:
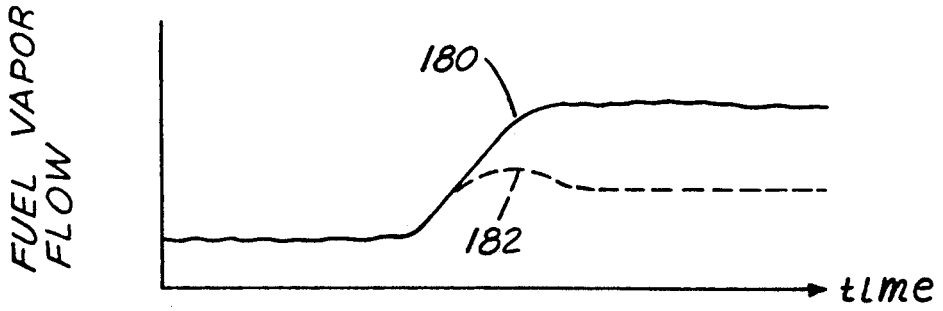
Figure 4D:
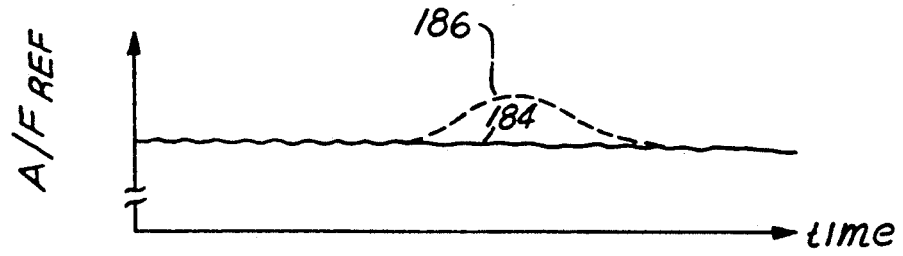

The operation of the fuel vapor recovery system and advantages thereof are shown graphically in FIGS. 4A–4D. Referring first to FIG. 4A, a hypothetical change in inducted air flow (MAF) is shown such as when the vehicle operator abruptly depresses the accelerator. In FIG. 4B the pressure differential between venturi inlet 34 and venturi throat 32 is shown corresponding to the change in inducted air flow. As shown by line 180 in FIG. 4C, fuel vapor flow corresponds to the pressure differential shown in FIG. 4B and, accordingly, the inducted air flow shown in FIG. 4A. Dashed line 182 in FIG. 4C represents fuel vapor flow in conventional systems wherein vapor flow through the solenoid valve becomes subsonic and is therefore not directly proportional to inducted air flow. Line 184 in FIG. 4D graphically illustrates that the inducted mixture of air, fuel, and fuel vapor is maintained at $A/F_{Ref}$ due to the fuel vapor recovery system described herein. On the other hand, the air/fuel ratio would otherwise incur a transient as shown by dashed line 186.

Figure 5:
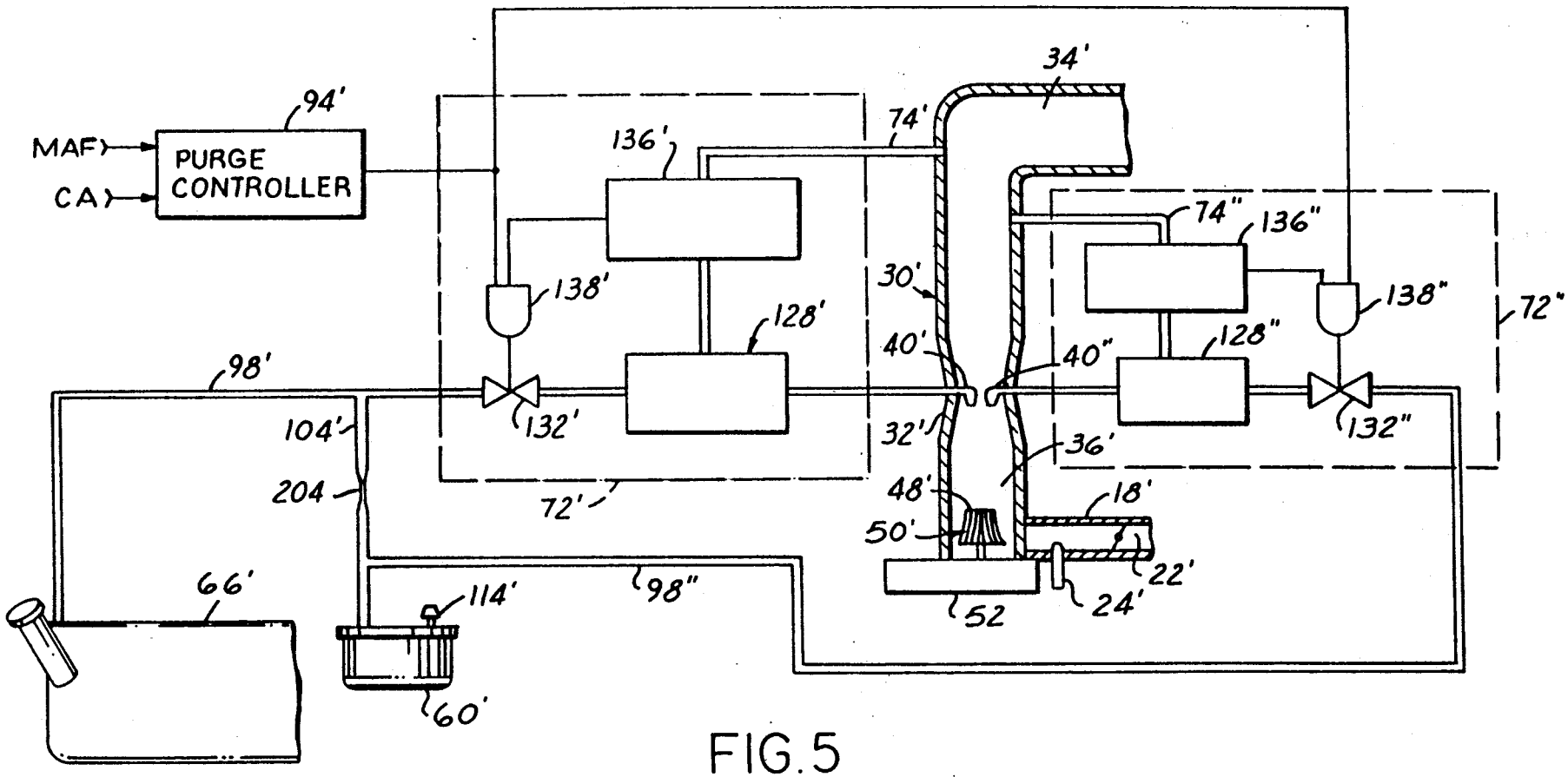
FIG. 5 is a block diagram of an alternate embodiment of the fuel vapor control system shown in FIG. 1.

An alternate embodiment is shown in FIG. 5 wherein like numerals refer to like components shown in FIGS. 1 and 2. In this particular embodiment, vapor recovery canister 60' is shown directly coupled to venturi throat 32' via second nozzle orifice 40''. pressure switch 136'' maintains vapor pressure in reservoir 128'' at approximately the pressure of venturi inlet 34'. The operation of solenoid valve 132'', reservoir 128'' and pressure switch 136'' is substantially identical to the operation and structure previously described herein with reference to solenoid valve 132', reservoir 128', and pressure switch 136'.

In the operation of the embodiment shown in FIG. 5, vapor flow from fuel tank 66' is linearly proportional to inducted air flow. Vapor flow from vapor storage canister 60' is independent of vapor flow from fuel tank 66' and is also made linearly proportional to inducted air flow. By utilizing the embodiment shown in FIG. 5, the proportion of fuel vapors contributed to engine 12 by fuel tank 66' and vapor canister 60' remains relatively constant thereby enhancing air/fuel ratio control by feedback controller 76. Stated another way, when a single vapor line is connected to pressure control system 72, the proportional vapor contribution from fuel tank 66 and fuel canister 60 is altered as fuel pressure and vapor flow vary. The embodiment shown in FIG. 5 solves this disadvantage by independently coupling fuel tank 66' and canister 60' to engine 12 via separate Pressure control system 72' and pressure control system 72''.

It is also noted in the embodiment shown in FIG. 5, that bleed line 104' between fuel tank 66' and vapor canister 60' includes restriction 204. Thus, when engine 12 is off, fuel vapors from fuel tank 66' flow through vapor canister 60' at a reduced rate to enable full adsorption of hydrocarbons.

The alternate embodiment shown in FIG. 5 may be further simplified by eliminating pressure switch 136'' and pressure reservoir 128'', and connecting the output of solenoid valve 132'' directly to nozzle orifice 40''. Atmospheric vent 114' from canister 60' would be connected to venturi inlet 34' through line 74''. In this manner, since canister 60' normally has zero internal pressure, the venturi differential pressure would cause fuel vapors to flow from the caster through nozzle 40'' in direct proportion to the inducted airflow. To insure that canister 60' does not become pressurized from fuel tank 66', a solenoid valve which would be closed during purging would be added in series with restriction 204 in line 104'.

This concludes the description of the preferred embodiment. The reading of it by those skilled in the art will bring to mind many alterations and modifications without departing from the spirit and scope of the invention. For example numerous pressure control systems may be used to advantage such as those utilizing mechanical valves responsive to a reference pressure rather than the electronically actuated valves shown herein. Accordingly, it is intended that the scope of the invention be limited only by the following claims.

What is claimed:

1. A control system for an internal combustion engine having an intake manifold inducting air and fuel from a fuel system into the engine, comprising:

fuel vapor recovery means coupled to the fuel system for providing fuel vapors to the intake manifold; said fuel vapor recovery means comprising a vapor storage canister coupled to a fuel tank and wherein said vapor storage canister and said fuel tank are independently coupled to said venturi throat;

a venturi having a venturi throat coupled to said intake manifold for inducting air therein;

vapor flow regulation means coupled between said fuel vapor recovery means and said venturi throat, said vapor flow regulation means being responsive to pressure differential between said venturi throat and a position upstream of said venturi throat for regulating flow of said fuel vapors in proportion to flow of said inducted air independently of pressure in the intake manifold; and air/fuel ratio feedback control means responsive to a calculation of air flow inducted into the intake manifold and also responsive to an exhaust gas oxygen sensor for regulating a mixture of air and fuel and fuel vapor inducted into the intake manifold.

2. A control system for an internal combustion engine having an intake manifold for inducting air and fuel from a fuel system into the engine, comprising:

a vapor storage canister coupled to a fuel tank of the fuel system;

a venturi having a venturi throat coupled to said intake manifold for inducting air therein;

first vapor flow regulation means coupled between said fuel tank and said venturi throat for regulating flow of fuel vapors from said fuel tank in proportion to flow of said inducted air independently of pressure in the intake manifold, said first vapor flow regulation means being responsive to pressure upstream of said venturi throat; and second vapor flow regulation means coupled between said vapor storage canister and said venturi throat for regulating flow of fuel vapors from said vapor storage canister in proportion to flow of said inducted air independently of pressure in the intake manifold and independently of vapor flow from said fuel tank, said first vapor flow regulation means being responsive to pressure upstream of said venturi throat.

3. The control system recited in claim 2 further comprising a first nozzle connected to said venturi throat and coupled to said first vapor flow regulating means.

4. The control system recited in claim 2 further comprising a second nozzle connected to said venturi throat and coupled to said second vapor flow regulating means.

* * * * *